US006214213B1

(12) United States Patent
Tipman et al.

(10) Patent No.: US 6,214,213 B1
(45) Date of Patent: Apr. 10, 2001

(54) SOLVENT PROCESS FOR BITUMEN SEPERATION FROM OIL SANDS FROTH

(75) Inventors: Robert Tipman, Sherwood Park; Yi-Cheng Long; William Edward Shelfantook, both of Edmonton, all of (CA)

(73) Assignees: AEC Oil Sands, L.P.; AEC Oil Sands Limited Partnership; Athabasca Oil Sands Investments Inc.; Canadian Occidental Petroleum Ltd.; Canadian Oil Sands Investments Inc.; Gulf Canada Resources Limited; Imperial Oil Resources, all of Calgary (CA); Mocal Energy Limited, Tokyo (JP); Murphy Oil Company Ltd.; Petro-Canada, both of Calgary (CA)

( * ) Notice: Subject to any disclaimer, the term of this patent is extended or adjusted under 35 U.S.C. 154(b) by 0 days.

(21) Appl. No.: 08/940,966

(22) Filed: Sep. 30, 1997

Related U.S. Application Data

(63) Continuation-in-part of application No. 08/443,767, filed on May 18, 1995, now Pat. No. 5,876,592.

(51) Int. Cl.[7] ..... C10G 1/04

(52) U.S. Cl. ..... 208/390; 208/14; 208/400; 208/391

(58) Field of Search ..... 208/390, 400, 208/14

(56) References Cited

U.S. PATENT DOCUMENTS

| | | | | |
|---|---|---|---|---|
| 4,120,776 | * | 10/1978 | Miller | 208/11 LE |
| 4,131,535 | * | 12/1978 | Porteous | 208/390 |
| 4,240,897 | * | 12/1980 | Clarke . | |
| 4,331,532 | * | 5/1982 | Bose | 208/390 |
| 4,448,667 | * | 5/1984 | Karnofsky | 208/390 |
| 4,539,097 | * | 9/1985 | Kelterborn et al. | 280/390 |
| 4,634,520 | | 1/1987 | Angelov et al. . | |
| 4,818,373 | * | 4/1989 | Bartholic et al. | 208/177 |
| 4,859,317 | * | 8/1989 | Shelfantook et al. | 208/390 |
| 5,236,577 | * | 8/1993 | Tipman et al. | 208/390 |

FOREIGN PATENT DOCUMENTS

| | | |
|---|---|---|
| 940853 | 1/1974 | (CA) . |

* cited by examiner

*Primary Examiner*—Helane Myers
(74) *Attorney, Agent, or Firm*—Millen, White, Zelano & Branigan, P.C.

(57) ABSTRACT

A paraffinic solvent is mixed with bitumen froth containing water and solids. Sufficient solvent is added to induce inversion when the mixture is subjected to gravity or centrifugal forces. The emulsion reports to the water phase and a dry bitumen product virtually free of inorganic solids, is obtained.

12 Claims, 3 Drawing Sheets

FIG. 1. Solvent Effect on Water Removal; 80°C Gravity Settling; S/F = 0.45
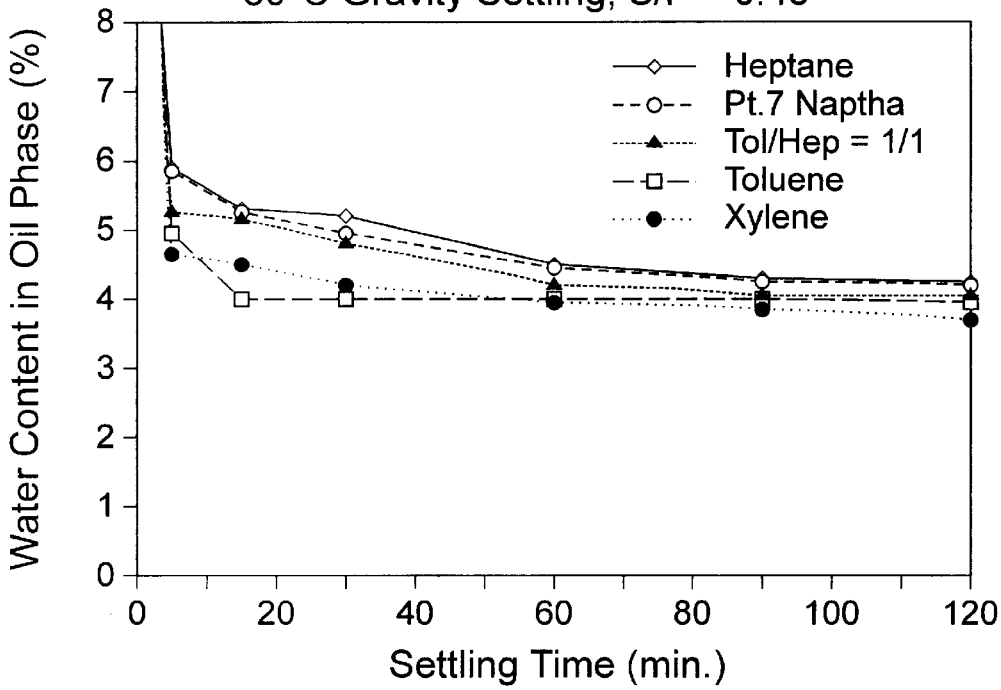
FIG. 2. Solvent Effect on Water Removal; 80°C Gravity Settling; S/F = 0.91
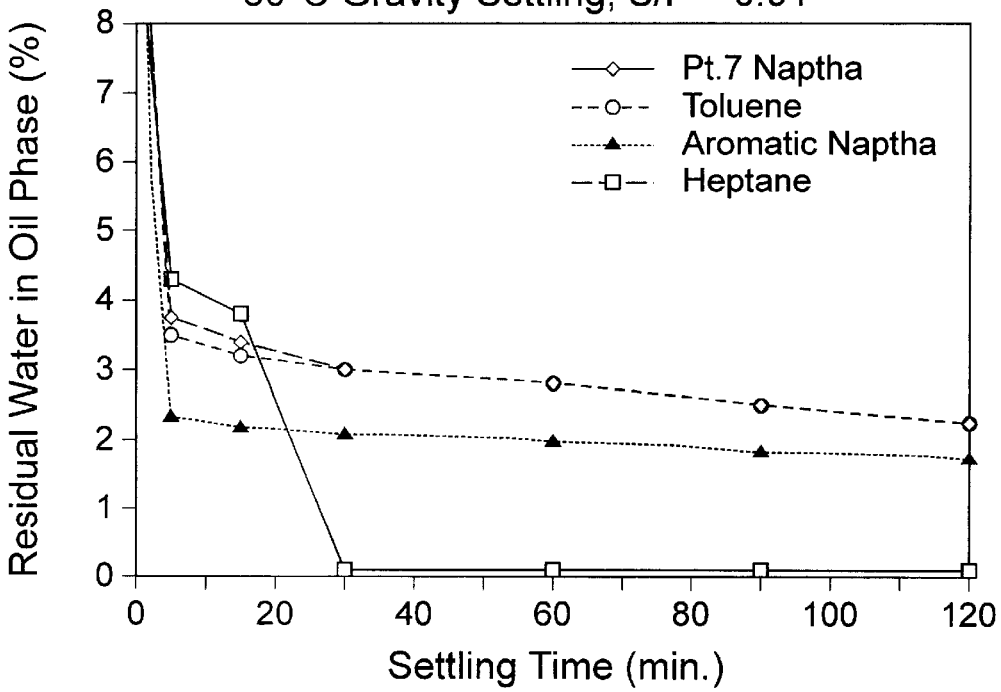

FIG. 2A. Effect of Solvent Molecular Weight on Water "Inversion"
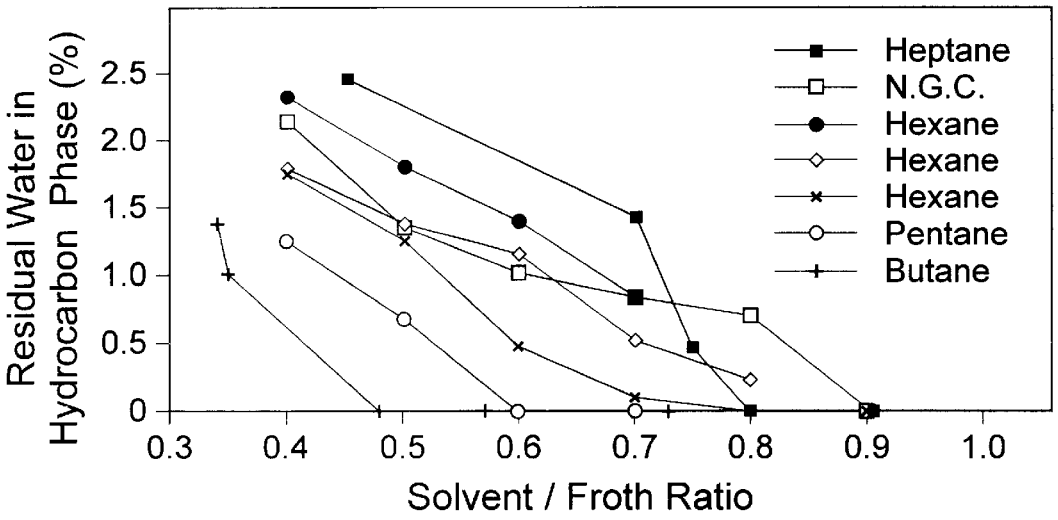
FIG. 2B. Effect of Adding Aromatics, Olefins and Cycloparaffins to a Pure Paraffin
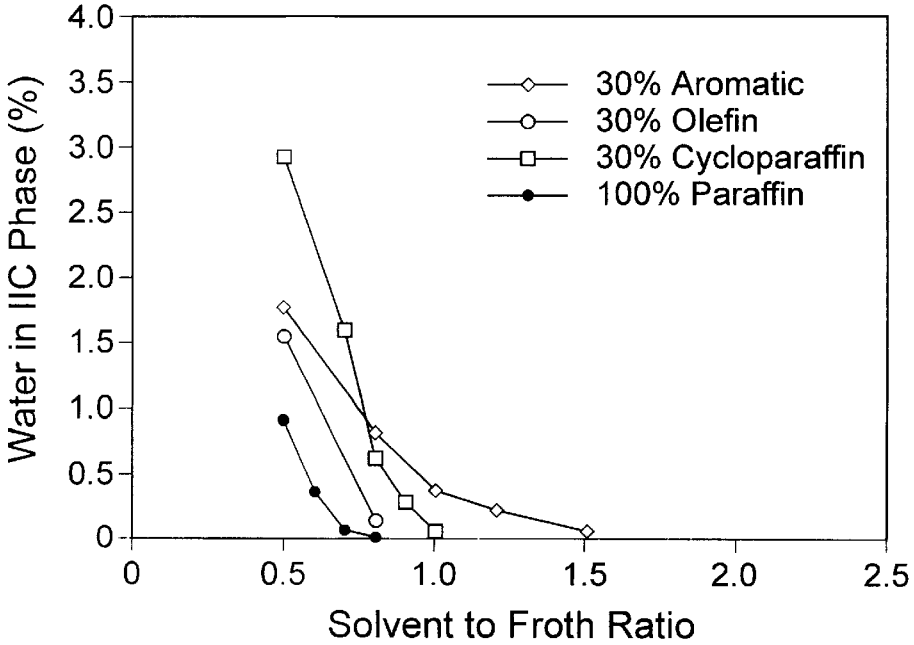

FIG. 3. Effect of Solvent / Froth Ratio on Water Removal; Heptane as Diluent; Centrifuging 2000 rpm, 10 min, 80°C
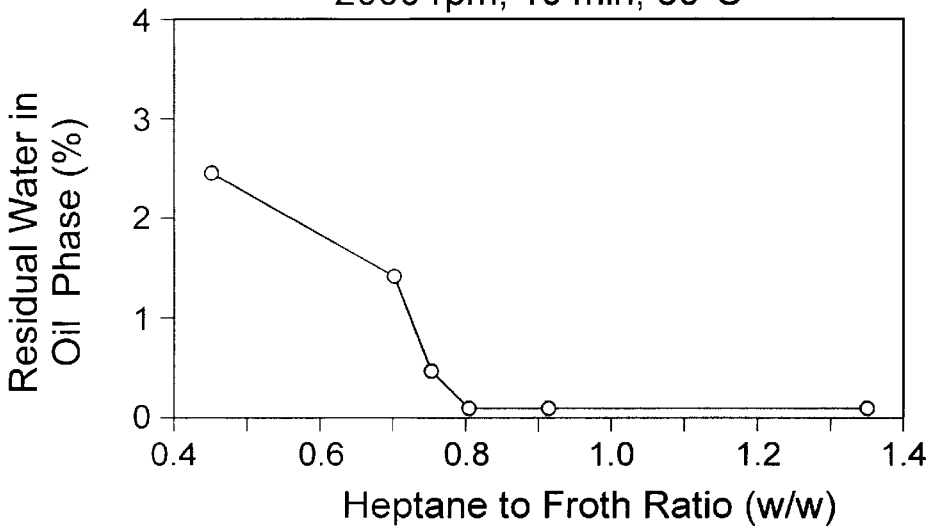
FIG. 4. Water Removal at Different Solvent to Froth Ratios; 40°C Gravity Settling; NG Condensate
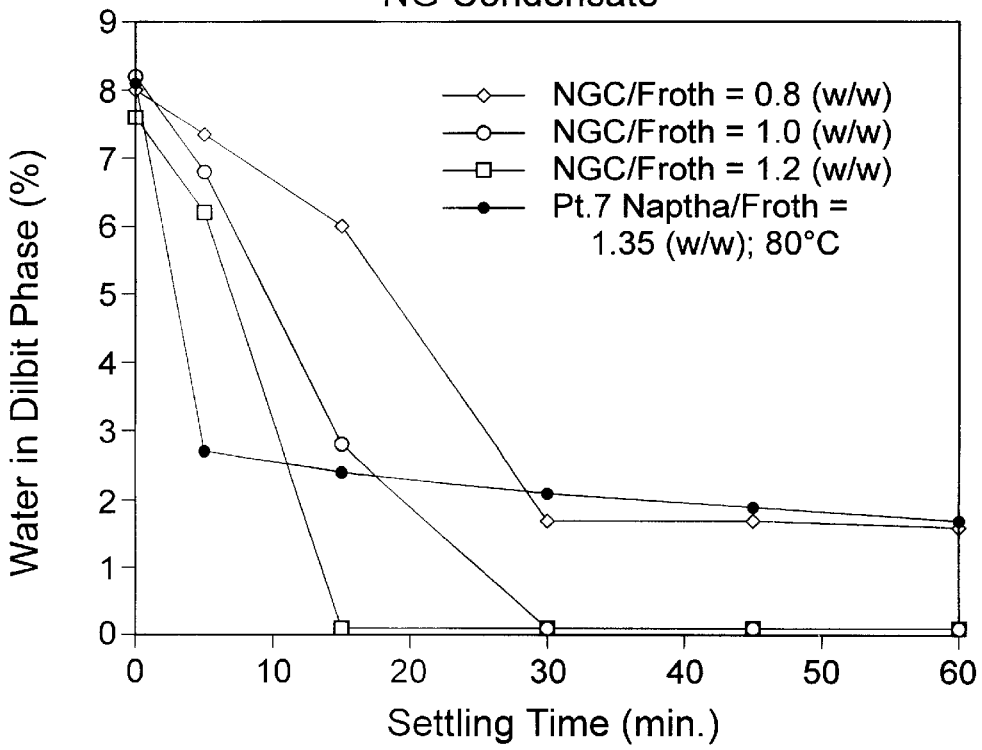

SOLVENT PROCESS FOR BITUMEN SEPERATION FROM OIL SANDS FROTH

CROSS-REFERENCE

This application is a continuation in part of application Ser. No. 08/443,767, filed May 18, 1995 now U.S. Pat. No. 5,876,592.

FIELD OF THE INVENTION

This invention relates to a paraffinic solvent addition method for separating water and solids from bitumen froth.

BACKGROUND OF THE INVENTION

The present invention has been developed in connection with a plant for extracting bitumen from the Athabasca oil sand deposit. At this operation, the oil sands are surface-mined and the contained bitumen is separated from the sand and recovered using what is known as the Clark hot water extraction process ("CHWE"). (The terms "oil" or "bitumen" are used interchangeably herein to identify the hydrocarbon content of oil sand.)

The CHWE process is well known to those in the industry and is described in the patent literature. The "front end" of the process, leading up to the production of cleaned, solvent-diluted bitumen froth, will now be generally described.

The as-mined oil sand is firstly mixed with hot water and caustic in a rotating tumbler to produce a slurry. The slurry is screened, to remove oversize rocks and the like. The screened slurry is diluted with additional hot water and the product is then temporarily retained in a thickener-like vessel, referred to as a primary separation vessel ("PSV"). In the PSV, bitumen globules contact and coat air bubbles which have been entrained in the slurry in the tumbler. The buoyant bitumen-coated bubbles rise through the slurry and form a bitumen froth. The sand in the slurry settles and is discharged from the base of the PSV, together with some water and a small amount of bitumen. This stream is referred to as "PSV underflow". "Middlings", comprising water containing non-buoyant bitumen and fines, collect in the mid-section of the PSV.

The froth overflows the lip of the vessel and is recovered in a launder. This froth stream is referred to as "primary" froth. It typically comprises 65 wt. % bitumen, 28 wt. % water and 7 wt. % particulate solids.

The PSV underflow is introduced into a deep cone vessel, referred to as the tailings oil recovery vessel ("TORV"). Here the PSV underflow is contacted and mixed with a stream of aerated middlings from the PSV. Again, bitumen and air bubbles contact and unite to form buoyant globules that rise and form a froth. This "secondary" froth overflows the lip of the TORV and is recovered. The secondary froth typically comprises 45 wt. % bitumen, 45 wt. % water and 10 wt. % solids.

The middlings from the TORV are withdrawn and processed in a series of sub-aerated, impeller-agitated flotation cells. Secondary froth, typically comprising 40 wt. % bitumen, 50 wt. % water and 10 wt. % solids, is produced from these cells.

The primary and secondary froth streams are combined to yield a product froth stream, typically comprising 60 wt. % bitumen, 32 wt. % water and 8 wt. % solids. This stream will typically have a temperature of 80° C.

The water and solids in the froth are contaminants which need to be reduced in concentration before the froth can be treated in a downstream refinery-type upgrading facility. This cleaning operation is carried out using what is referred to as a "dilution centrifuging circuit".

More particularly, the combined froth product is first deaerated and then diluted with sufficient solvent, specifically naphtha, to provide a solvent to froth ("S/F") ratio of about 0.45 (w/w). This is done to increase the density differential between the bitumen on the one hand and the water and solids on the other. The diluted froth is then processed in a scroll-type centrifuge, to remove coarse solids. The bitumen product from the scroll machine is subsequently processed in a disc-type centrifuge, to remove water and fine clay solids.

The "cleaned" bitumen product from the dilution centrifuging circuit typically contains 3 to 5 wt. % water and about 0.6 wt. % solids.

The underflows from the TORV, the flotation cells and the dilution centrifuging circuit are discharged as tailings into a pond system. Water is recycled from this pond for use as plant process water.

There are two significant problems associated with producing a cleaned diluted froth still containing such quantities of water and solids. Firstly, one is precluded from shipping the product through a commercial pipeline that is conveying discrete shipments of a variety of hydrocarbon products. Such pipelines require that any product shipped must contain less than 0.5 wt. % B S and W (bottom settlings and water). Because of this requirement, one must upgrade the cleaned diluted froth produced by the dilution centrifuging circuit in a refinery-type upgrading circuit located close to the mining site, before shipping it. Providing and operating an upgrading circuit at the mine site is very expensive. Secondly, there is a build-up in the concentration of chlorides in plant process water that occurs over time. This build-up arises from recycling water from the tailings pond to the tumbler and re-using the tailings water as part of the water used as process water. In addition, the incoming oil sands contain salt which adds to the chloride content in the process water. Keeping in mind that the cleaned diluted bitumen product from the dilution centrifuging circuit contains a significant fraction of plant water, chlorides are brought by this fraction into the upgrading circuit. These chlorides are harmful in the upgrading circuit, as they cause corrosion and catalyst fouling.

The industry has long understood that it would be very desirable to produce a dry diluted bitumen froth product containing less than about 0.5 wt. % water plus solids. Stated alternatively, it would be desirable to separate substantially all of the water and solids from the froth.

Many potential solutions have been explored. These have included electrostatic desalting, water-washing, chemicals addition, third stage centrifuging and high temperature froth treatment. However, no effective and practical technique has yet emerged which would produce dry bitumen with little accompanying bitumen loss with the water.

There are various reasons why no successful technique has yet been devised for cleaning bitumen froth to reduce the water plus solids content below 0.5 wt. %. The major reason is that the water remaining in naphtha-diluted bitumen froth is finely disseminated in the bitumen as globules having a diameter of the order of 3 microns or less. The mixture is an emulsion that tenaciously resists breakdown.

In this background, only the CHWE process has been mentioned. There are other water extraction processes—such as the known OSLO process, the Bitumen process, and the Kryer process—which also produce bitumen froth which can be cleaned by this invention.

With this background in mind, it is the objective of the present invention to provide a new method for cleaning bitumen froth, produced by a water extraction process, which method is effective to better reduce the water plus solids content, preferably to about 0.5 wt. % or less.

SUMMARY OF THE INVENTION

The present invention is directed toward the breaking of the water emulsion in bitumen froth. The invention is based on the discovery that a paraffinic solvent, if added to the bitumen froth in sufficient amount, causes an inversion of the emulsion. That is, the emulsion, a complex mixture of water, bitumen, solvent and solids, which is initially in the hydrocarbon phase, is transferred into the aqueous phase. As a result of the inversion, contained water effectively separates from the diluted froth under the influence of gravity or centrifugal forces. The product is essentially dry diluted bitumen, preferably having a solids and water content less than 0.5 wt. %. (This product is hereafter referred to as dry bitumen.)

It is believed that the water globules agglomerate in the presence of the critical concentration of the paraffinic solvent and acquire the capacity to segregate from the hydrocarbon.

In a preferred embodiment, the invention involves a method for cleaning bitumen froth containing water and particulate solids contaminants, said froth having been produced by a water extraction process practised on oil sands, comprising: adding paraffinic solvent to the froth in sufficient amount to produce a solvent to froth ratio ("S/F") of at least 0.6 (w/w); mixing sufficiently to disperse the solvent in the bitumen; and subjecting the mixture to gravity or centrifugal separation for sufficient time to reduce its water plus solids content to less than about 0.5 wt %. Most preferably the solvent used is natural gas condensate, a mixture of low molecular weight alkanes with chain lengths from about $C_5$–$C_{16}$, added in sufficient amount to produce a solvent to froth ratio of about 1.0 (w/w).

The invention is characterized by the following advantages:

- substantially all of the water and solids can be removed from the froth by diluting it with sufficient paraffinic solvent;
- bitumen losses with the separated water are only slightly lower than for the conventional process;
- unless the amount of solvent added is high enough to cause asphaltenes to precipitate, the asphaltene content in bitumen lost with the water is no higher than that normally associated with bitumen—thus the lost bitumen can be recovered from the water using conventional techniques; and
- the new method has been shown to be effective at relatively low temperatures (40–50° C.), which raises the possibility that the extraction process can be run at lower temperatures.

The method of this invention involves the mixing of the solvent with the bituminous froth in a vessel for a sufficient time to ensure the complete dispersion of the solvent into the froth. Normally, this can be carried out in a stirred tank with a nominal retention time of 5 minutes. The separation itself can be carried out in the same vessel by stopping the agitation and permitting the water droplets to separate under the influence of gravity. In a continuous process, the separation can be conducted in a separate settling vessel which is connected by piping to the mixing vessel.

DESCRIPTION OF THE DRAWINGS

FIG. 1 is a plot showing the residual water content remaining in the oil phase over time in a gravity settling test where the bitumen froth has been diluted with various solvents at conditions which are conventional: 80° C., S/F ratio 0.45 w/w. The Plant 7 naphtha represents the conventional solvent used in the commercial plant owned by the present assignees;

FIG. 2 is a plot similar to FIG. 1, showing the residual water content remaining in the oil phase over time in a gravity settling test for runs conducted at the same conditions as those of FIG. 1, except that the S/F ratio was increased to 0.91—of significance is the elimination of water from the oil phase at this S/F ratio;

FIG. 2*a* is a plot showing the residual water content remaining in the hydrocarbon phase after treatment of bitumen froth with paraffinic solvents of different molecular weights, ranging from butane to heptane at different solvent/froth ratios;

FIG. 2*b* is a plot comparing the impact of three types of impurities (olefins, naphthenes and aromatics) on the ability of a pure paraffin (Heptane) to produce dry bitumen;

FIG. 3 is a plot showing the residual water content remaining in the oil phase after 30 minutes of settling time for runs using heptane as the solvent at different S/F ratios. Conditions: centrifuging at 2000 rpm for 10 mins., 80° C.—the results indicate that inversion occurred at a S/F ratio of about 0.75–0.80;

FIG. 4 is a plot showing the residual water content remaining in the oil phase over time in a gravity settling test using: (a) natural gas condensate ("NGC") as the solvent for runs at different S/F ratios, and (b) the results of a single run using Plant 7 naphtha as the solvent at a high S/F ratio—of significance is the inversion for NGC at an S/F ratio of about 1.00 to 1.20.

DESCRIPTION OF THE PREFERRED EMBODIMENT

A comparative testing program was undertaken under laboratory conditions. Different solvents were added to bitumen froth as diluents. The solvents varied in aromatic and paraffin contents. Various solvent/froth ratios were tried for each diluent. Various temperatures were tried. After adding the solvent, the diluted froth was centrifuged or gravity settled and the residual water, chloride and solids contents in the bitumen fraction were determined. The resulting data were then assessed.

In the course of the testing, certain discoveries were made, as described below. The inventive process is based on these discoveries.

More particularly, the test program involved the following materials and procedures:

A single froth was used for all of the test runs. This froth assayed as follows:

| | |
|---|---|
| oil (or bitumen) | 66.22 wt. % |
| water | 24.59 wt. % |
| solids | 9.65 wt. % |

The solvents used in the test are set forth in Table 1.

TABLE 1

Solvents Used For Water Removal Studies From Froth

| Class.** | Solvent | Source | Aromatics Content (%) | b.p. (° C.) | Density (g/ml) |
|---|---|---|---|---|---|
| A | Pt. 7 Naphtha | SCL Pt. 7 | ~15% | 82~171 | 0.770 |
| A | Aromatic naphtha | Esso | ~98% | 143~186 | 0.872 |
| A | Toluene | Fisher Sci. | 100% | 111 | 0.866 |
| A | Xylene | Fisher Sci. | 100% | 139 | 0.868 |
| P | Hexane | Fisher Sci. | 0% | 69 | 0.664 |
| P | Heptane | Fisher Sci. | 0% | 98 | 0.684 |
| P | i-Octane | Fisher Sci. | 0% | 100 | 0.688 |
| P | Hexadecane | Fisher Sci. | 0% | 287 | 0.773 |
| P | Bayol 35(Light paraff.oil)* | Fisher Sci. | very low | light | 0.780 |
| | Cyclohexane | Fisher Sci. | 0% | 81 | 0.779 |
| | Cyclohexane | Fisher Sci. | 0% | 83 | 0.810 |

*indicates a trade mark
**A - designates an "aromatic" or non-paraffinic solvent
P - designates a "paraffinic" solvent The solvent used in applicants' commercial operation is referred to as Plant 7 naphtha. This solvent is applied in the plant with a solvent/froth ratio of about 0.45. It will be noted that Plant 7 naphtha has an aromatics content of approximately 15%.

Water contents in solvent-diluted bitumen and settled water samples were determined by Karl-Fischer titration.

The procedure for the gravity settling runs was as follows, unless otherwise described. Bitumen froth and diluent samples were separately placed into a water bath operated at the temperature desired for the run. Once at temperature, samples of froth and diluent were weighed out, to yield the desired solvent/froth ratio for the run, and combined in a 32 ounce mixing jar. The diluent and froth in the jar were mixed at 500 rpm for 10 minutes using a blade mixer.

Upon completion of mixing, the mixture was allowed to stand in the jar in the bath to effect gravity settling.

Samples were taken at 0, 5, 15, 30, 60, 90 and 120 minute intervals. The location of the sampling point was about the mid-point of the hydrocarbon fraction. The collected samples were analyzed for water content.

Two samples of diluted bitumen product were collected from each run after 120 minutes of settling. One was analyzed for chloride content; the other was analyzed for solids content.

The procedure for the centrifuging runs was as follows, unless otherwise described. The bitumen froth and diluent samples were pre-heated to the run temperature in a water bath. Once at temperature, samples of froth and diluent were weighed out, to yield an 80 ml sample having the desired solvent/froth ratio, and transferred into a 125 ml glass jar.

The glass jar was placed in a shaker and shaken rigorously for 5 minutes, to mix the components.

The mixture was then introduced into a 100 ml centrifuge tube and spun at 2000 rpm for 10 minutes.

After centrifuging, two diluted bitumen product samples were taken. One sample was analyzed for water content. The other was analyzed for chloride content.

In the Examples below, solids content of the product bitumen was analyzed by the Dean Stark method. This involves placing the samples in a porous thimble in a distillation apparatus with toluene. The sample is washed by refluxing hot toluene to dissolve all of the "bitumen" which accumulates in the still pot. Water condenses overhead and is trapped in a "measuring boot" in the condenser. "Solids" remain behind in the porous thimble, and are weighed after the distillation is complete.

Samples of product bitumen from the Paraffin Froth Treatment process which have been subjected to the Dean Stark analysis generally contained in the range of 0.00%–0.15% (w/w) solids. Conventional coker feed bitumen contains approximately 1% (w/w) solids.

EXAMPLE I

In this test, a group of solvents were tested at a S/F ratio of 0.45 (w/w), to assess their capability to remove froth water with gravity settling. The test was run at 80° C. The solvents are described in Table I and identified in FIG. 1.

As previously stated, the S/F ratio of 0.45 is that used in the commercial plant dilution centrifuging circuit. Plant 7 naphtha is the solvent used in the circuit. The test Temperature (80° C.) is the same as that used in the plant circuit.

The results are tabulated in Table 2 and presented in FIG. 1.

As shown, the solvents with high aromaticity gave equivalent or better water removal when compared to the paraffinic solvent-heptane, at this S/F ratio.

In all of the runs, the residual water content in the diluted bitumen product after 120 minutes of settling was still in excess of 3%.

In summary, at the conventional S/F ratio, the aromatic solvents were as good at inducing water separation as the paraffinic solvent; none of the solvents reduced the water content below 3%.

TABLE 2

Residual Water in Hydrocarbon Phase by Gravity Settling at 80° C. Using Different Solvents at S/F Ratio = 0.45

| Settling time mins | Heptane | Pt.7 naphtha Tol/Hep = 1/1 Water Content/ in Oil Phase (%) | | Toluene | Xylene |
|---|---|---|---|---|---|
| 0 | 15.67 | 14.81 | 14.67 | 14.36 | 13.50 |
| 5 | 5.93 | 5.84 | 5.24 | 4.95 | 4.69 |
| 15 | 5.35 | 5.25 | 5.14 | 4.05 | 4.51 |
| 30 | 5.16 | 4.93 | 4.82 | 4.05 | 4.23 |
| 60 | 4.48 | 4.36 | 4.28 | 4.08 | 4.00 |

TABLE 2-continued

| Residual Water in Hydrocarbon Phase by Gravity Settling at 80° C. Using Different Solvents at S/F Ratio = 0.45 | | | | | |
|---|---|---|---|---|---|
| Settling time mins | Heptane | Pt.7 naphtha | Tol/Hep = 1/1 Water Content/ in Oil Phase (%) | Toluene | Xylene |
| 90 | 4.33 | 4.22 | 4.15 | 4.07 | 3.82 |
| 120 | 4.25 | 4.11 | 4.10 | 3.95 | 3.69 |

EXAMPLE II

This example reports on a group of runs involving gravity settling and which were carried out at 80° C. using various solvents at a relatively high S/F ratio of 0.91 (w/w).

The results are shown in Table 3 and FIG. 2.

TABLE 3

| Residual Water in Hydrocarbon Phase by Gravity Settling at 80° C. Using Different Solvents at S/F Ratio = 0.91 | | | | |
|---|---|---|---|---|
| Settling time mins | Pt.7 naphtha | Toluene | Aromatic Naphtha Water Content in Oil Phase (%) | Heptane |
| 0 | 10.89 | 9.13 | 9.41 | 9.32 |
| 5 | 3.74 | 3.47 | 2.41 | 4.28 |
| 15 | 3.44 | 3.21 | 2.26 | 3.78 |
| 30 | 3.02 | 3.05 | 2.14 | <0.10 |
| 60 | 2.76 | 2.74 | 2.09 | <0.10 |
| 90 | 2.47 | 2.47 | 1.91 | <0.10 |
| 120 | 2.27 | 2.25 | 1.80 | <0.10 |

It will be noted that, at an S/F ratio of 0.91 (w/w), the residual water content in the oil phase was reduced from about 4% (Example I) to about 2–2.5% for the aromatic solvents tested.

However, the heptane run at the same S/F ratio gave a dramatically different result. After about 15 minutes of settling time, an apparent inversion of the emulsified water was initiated and virtually all of the emulsion settled into the water phase after 30 minutes of settling.

Heptane is a paraffinic solvent. These runs disclose the discovery that a paraffinic solvent at a sufficient S/F ratio will remove substantially all of the water from diluted bitumen froth when gravity settled.

EXAMPLE III

In this test, runs involving gravity settling were carried out at 80° C. using various solvents at increasing S/F ratios.

The results are presented in Table 4.

It will be noted that for heptane, the residual water content could be reduced to a low value (0.1%) in decreasing settling time as the S/F ratio was increased above about 0.80.

The data shows that an inversion can be obtained using heptane when the S/F ratio is at least about 0.80. This inversion is initiated in less time as the ratio is further increased.

The Table 4 data further shows that the aromatic solvents (toluene, aromatic naphtha, Plant 7 naphtha) were not capable of producing dry bitumen product at high S/F ratios of 0.91 and 1.35.

TABLE 4

| Residual Water in Hydrocarbon Phase by Gravity Setting at 80° C. Using Different Solvents at Different Solvent To Froth Ratios | | | | | | |
|---|---|---|---|---|---|---|
| Solvent | Heptane | Heptane | Heptane | Heptane | Heptane | Heptane |
| Solvent/Froth Ratio (w/w) | 0.70 | 0.75 | 0.80 | 0.91 | 1.35 | 1.35 |
| | Water Content in Oil Phase (%) | | | | | |
| Settling time (min) 0 | 11.88 | 11.45 | 11.36 | 9.32 | 9.29 | 8.81 |
| 5 | 4.64 | 4.44 | 4.24 | 4.28 | 4.23 | 2.28 |
| 15 | 4.13 | 1.48 | 2.96 | 3.78 | 3.82 | <0.1 |
| 30 | 3.66 | 1.04 | 0.31 | <0.1 | <0.1 | <0.1 |
| 60 | 3.36 | 0.56 | 0.11 | <0.1 | <0.1 | <0.1 |
| 90 | 3.08 | 0.26 | 0.13 | <0.1 | <0.1 | <0.1 |
| 120 | 2.71 | 0.13 | <0.1 | <0.1 | <0.1 | <0.1 |
| Solvent | Toluene | Toluene | Aromatic Naphtha | Plant 7 Naphtha | Plant 7 Naphtha | |
| Solvent/Froth (w/w) | 0.91 | 1.35 | 0.91 | 0.91 | 1.35 | |
| | Water Content in Oil Phase (%) | | | | | |
| Settling time (min) 0 | 9.13 | 8.20 | 9.41 | 10.89 | 8.03 | |
| 5 | 3.47 | 2.74 | 2.41 | 3.74 | 2.71 | |
| 15 | 3.21 | 2.46 | 2.26 | 3.44 | 2.40 | |
| 30 | 3.05 | 2.25 | 2.14 | 3.02 | 2.08 | |
| 60 | 2.74 | 2.03 | 2.09 | 2.76 | 1.71 | |
| 90 | 2.47 | 1.65 | 1.91 | 2.47 | 1.47 | |
| 120 | 2.25 | 1.44 | 1.8 | 2.27 | 1.22 | |

EXAMPLE IV

This example reports on runs involving centrifugation separation and use of hexane as the solvent. The results are presented in Table 5. The runs were conducted at temperatures ranging from 30° C. to 60° C. with increasing S/F ratios. The other runs were conducted at varying temperatures with a constant S/F ratio.

The results indicate that inversion occurs for hexane at 60° C. at a S/F ratio of about 0.6. It further suggests that the S/F ratio required for inversion diminishes with a lighter solvent.

The results further indicate that the invention is operative at temperatures which are low (e.g. 40° C.) relative to conventional temperatures (80° C.) for dilution centrifuging.

TABLE 5

Residual Water, Chloride and Solids in Hydrocarbon Phase After Centrifuging Using Hexane as Solvent at Different Temperatures

| Solvent | S/F (w/w) | Mixing temp. (° C.) | Cent. temp. (° C.) | Water (%) | Chloride (ppm) |
|---|---|---|---|---|---|
| Hexane | 0.50 | 60 | 60 | 2.95 | 24.0 |
| Hexane | 0.55 | 60 | 60 | 2.47 | 10.1 |
| Hexane | 0.60 | 60 | 60 | <0.1 | <1 |
| Hexane | 0.70 | 60 | 60 | <0.1 | <1 |
| Hexane | 0.80 | 60 | 60 | <0.1 | <1 |
| Hexane | 1.00 | 60 | 60 | <0.1 | 2.2 |
| Hexane | 0.70 | 50 | 50 | <0.1 | <1 |
| Hexane | 0.70 | 40 | 40 | <0.1 | <1 |
| Hexane | 0.70 | 30 | 30 | 0.76 | 3.8 |
| Hexane | 0.70 | 60 | 30 | <0.1 | |

EXAMPLE IV-A

This example illustrates the effectiveness of pure paraffinic solvents of different molecular weights. The solvents tested were butane (C4), pentane (C5), hexane (C6), and heptane (C7). Froth treatment was carried out under conditions similar to those set out in Example IV. The solvent/froth ratio was varied for each solvent over the range 0.3 to 0.9. The results, shown graphically in FIG. 2A, indicate that as the molecular weight of the solvent increased from C4 to C7, the solvent/froth ratio required to produce dry (zero water concentration)_bitumen increased from slightly less than 0.5 for butane to about 0.8 for heptane. This example suggests that inversion occurs at an essentially constant molar ratio of solvent to bitumen. It will be appreciated from the foregoing that the molecular weight of the paraffin used must be taken into consideration in setting the solvent/froth ratio. At least for the paraffins tested, the trend appears to be that a higher molecular weight paraffin must be used in higher mass ratios than a lower molecular weight paraffin.

EXAMPLE V

Table 6 illustrates the effect of temperature on water removal. Hexane was used as a diluent at a hexane/froth ratio of 0.7 w/w and the hydrocarbon samples were centrifuged at 2000 rpm for 10 minutes at temperatures different from the mixing temperature. The data illustrate that separation of the water from the hydrocarbon can be achieved at temperatures above about 30° C.

TABLE 6

Effect of Mixing Temperature and Centrifuging Temperature on Separation of Water from Hexane Diluted Froth Hexane/Froth Ratio = 0.7 w/w, Centrifuging 10 mins. at 2000 rpm

| Ratio: Mixing Temp ° C./ Centrifuging Temp. ° C. (M° C./C° C.) | M30/ C30 | M60/ C30 | M40/ C40 | M50/ C50 | M60/ C60 |
|---|---|---|---|---|---|
| Water Content in Hydrocarbon, wt. % | 0.76 | <0.10 | <0.10 | <0.10 | <0.10 |

EXAMPLE VI

Table 7 illustrates the solids content for the runs of FIG. 2 resulting from the use of heptane solvent at 0.91 solvent/froth ratio, and residual solids contents for hydrocarbons where toluene and Plant 7 naphtha were used as diluents.

TABLE 7

Effect of Diluent Type on Solids Removal from Froth Settling Temperature 80° C., S/F Ratio = 0.91

| Diluent Type | Heptane | Toluene | Plant 7 Naphtha |
|---|---|---|---|
| Solids Residue in Hydrocarbon, wt. % | 0.15 | 0.75 | 0.79 |

EXAMPLE VII

This example reports on runs involving centrifugation separation and use of paraffinic, cycloparaffinic and olefinic solvents at varying temperatures and a S/F ratio of 1.00 w/w.

Table 8 illustrates the effect of cycloparaffinic (cyclohexane) and olefinic (cyclohexane) solvents on water removal at solvent/froth ratios of 1.0 w/w. It is clearly shown that non-paraffinic solvents do not achieve the water removal of paraffinic solvents.

TABLE 8

Residual Water and Chloride in Bituminous Froth Diluted with Various Hydrocarbon Solvents After Centrifuging

| Solvent | Paraffinic Content | b.p. (° C.) | Density (g/ml) | S/F (w/w) | Mixing Temp (° C.) | Cent. Temp. (° C.) | Water (%) | Chloride (ppm) |
|---|---|---|---|---|---|---|---|---|
| Hexane | 100% | 69 | 0.664 | 1.00 | 60 | 60 | <0.1 | 2.2 |
| Heptane | 100% | 98 | 0.648 | 1.00 | 80 | 80 | <0.1 | <1 |
| i-Octane | 100% | 100 | 0.688 | 1.00 | 80 | 80 | <0.1 | <1 |
| Hexadecane | 100% | 287 | 0.773 | 1.00 | 80 | 80 | <0.1 | <1 |
| Bayol 35* | 98+% | | 0.780 | 1.00 | 80 | 80 | <0.1 | <1 |

TABLE 8-continued

Residual Water and Chloride in Bituminous Froth Diluted with Various Hydrocarbon Solvents After Centrifuging

| Solvent | Paraffinic Content | b.p. (° C.) | Density (g/ml) | S/F (w/w) | Mixing Temp (° C.) | Cent. Temp. (° C.) | Water (%) | Chloride (ppm) |
|---|---|---|---|---|---|---|---|---|
| Cyclohexane | 0% | 81 | 0.779 | 1.00 | 80 | 80 | 2.04 | 16.5 |
| cyclohexane | 0% | 83 | 0.810 | 1.00 | 80 | 80 | 2.36 | 19.0 |

*TradeMark

Bayol 35 is a blend of higher molecular weight paraffins ($C_{12+}$)

As shown:

The paraffinic solvents (hexane, heptane, i-octane, hexadecane and Bayol 35) were all successful in producing dry (0.1%) diluted bitumen product. This group of paraffinic solvents included normal paraffins, isoparaffins (i-octane) and paraffin blends (Bayol 35);

The cycloparaffinic and olefinic solvents were not successful in producing a dry diluted bitumen product;

Residual chlorides in the hydrocarbon phase were less than 1 ppm when paraffinic solvents were used. Cycloparaffinic and olefinic solvents yielded higher chloride contents in the hydrocarbon, which were consistent with retention of salt in the residual water.

The term "paraffinic solvent" is used in the claims. This term is intended to cover solvents containing normal paraffins, isoparaffins and blends thereof in amounts greater than 50 wt. %. It is not intended to include olefins, naphthas or cycloparaffins.

EXAMPLE VII-A

The experiments reported in this example examined the impact of compounds such as aromatics, olefins and naphthenes on the ability of paraffins to produce dry bitumen. These tests were carried out because paraffinic solvents which are inexpensive enough to use on a commercial scale are not pure paraffins. For example, natural gas condensate (NGC) contains about 83% paraffins, but also significant amounts of aromatics and naphthenes. Other tests reported on herein (see Table II) demonstrated that when NGC is used as the froth diluting solvent, the solvent/froth ratio required to produce dry bitumen is significantly higher than for pure paraffins, at approximately 1.0 (mass/mass). The inventors believed that it was important to identify compounds which are inhibitors to the action of paraffins in froth treatment. Such information could be useful for designing and producing an economically viable solvent from existing process materials.

To minimize the effect of molecular weight, a family of compounds was selected that were close together in molecular weight, as follows:

heptane (pure paraffin), methyl cyclohexane (naphthene), and toluene (aromatic).

The tests were carried out on a single froth sample using the procedure outlined above for centrifuging runs. The solvent mixtures tested contained heptane with varying concentrations of the three non-paraffinic test solvents, which were added on a volume/volume basis. For each solvent mixture, a series of tests was run, increasing the solvent/froth ratio until either a dry bitumen was produced, or the solvent/froth ratio became too high for more solvent to be added to the test vessels.

The results of the tests are summarized in Tables 8a, 8b, 8c and 8d and FIG. 2*b*. Table 8a shows that for pure heptane, dry bitumen is produced at a solvent/froth ratio of 0.80. The effect of addition of an olefin (hexane) even at 30% (v/v), was relatively small. It increased the solvent/froth requirement to produce dry bitumen was from 0.8 to 1.0 (Table 8b). A more pronounced effect was observed with the addition of naphthene, methyl cyclohexane. Added at only 10% (v/v), it increased the effective solvent froth ratio from 0.8 to 1.0 (Table 8c). At 20% and 30% naphthene, the product contained measurable water at a solvent/froth ratio of 1.0. The addition of an aromatic, toluene, at 10% (v/v) increased the effective solvent/froth ratio to 1.2.

In FIG. 2*b*, the effect of the three non-paraffinic compounds at 30% (v/v) are compared in terms of the water content remaining in the treated bitumen at varying solvent/froth ratios.

To summarize, this example suggests that aromatic and naphthene impurities in a paraffinic solvent will significantly increase the amount of solvent required to produce dry bitumen. Olefin impurities appear to be less important.

TABLE 8a

Summary of Results, Pure Paraffin (heptane)

| Solvent to Froth Ratio | Upper Phase Density | Solvent Density | Solvent Bitumen Ratio | Density Hydro-carbon | Water Content of HC Phase |
|---|---|---|---|---|---|
| 0.49 | 0.8453 | 0.6838 | 0.6980 | 0.8452 | 0.91 |
| 0.61 | 0.8161 | 0.6838 | 1.0083 | 0.8155 | 0.37 |
| 0.71 | 0.8035 | 0.6838 | 1.1768 | 0.8035 | 0.07 |
| 0.80 | 0.8020 | 0.6838 | 1.2007 | 0.8020 | 0.01 |

TABLE 8b

Summary of Results, Olefin/Paraffin Mixtures

| Hexane Concentration in Heptane | Solvent to Froth Ratio | Upper Phase Density | Solvent Density | Solvent to Bitumen Ratio | Density of Hydrocarbon | Water Content of HC Phase |
|---|---|---|---|---|---|---|
| 10 | 0.50 | 0.8406 | 0.6832 | 0.7413 | 0.8399 | 1.31 |
| 10 | 0.70 | 0.8235 | 0.6832 | 0.9094 | 0.8233 | 0.25 |
| 10 | 0.80 | 0.8024 | 0.6832 | 1.1869 | 0.8024 | 0.04 |
| 10 | 0.98 | 0.7853 | 0.6832 | 1.4987 | 0.7853 | 0.00 |
| 20 | 0.50 | 0.92887 | 0.6826 | 0.2299 | 0.9283 | 1.62 |
| 20 | 0.70 | 0.8259 | 0.6826 | 0.8760 | 0.8259 | 0.21 |
| 20 | 0.81 | 0.8115 | 0.6826 | 1.0504 | 0.8114 | 0.05 |
| 20 | 1.01 | 0.8014 | 0.6826 | 1.196 | 0.8014 | 0.00 |
| 30 | 0.50 | 0.8475 | 0.6820 | 0.6743 | 0.8470 | 1.55 |
| 30 | 0.80 | 0.8056 | 0.6820 | 1.1257 | 0.8056 | 0.16 |
| 30 | 1.00 | 0.7870 | 0.6820 | 1.4455 | 0.7870 | 0.00 |
| 100 | 0.70 | 0.8427 | 0.6780 | 0.6887 | 0.8427 | 1.34 |
| 100 | 1.00 | 0.7826 | 0.6780 | 1.4693 | 0.7826 | 0.00 |
| 100 | 1.50 | 0.7659 | 0.6780 | 1.8771 | 0.7659 | 0.00 |

TABLE 8c

Summary of Results, Naphthene/Paraffin Mixtures

| Methyl Cyclo-hexane Concentration in Heptane | Solvent to Froth Ratio | Upper Phase Density | Solvent Density | Solvent to Bitumen Ratio | Density of Hydrocarbon | Water Content of HC Phase |
|---|---|---|---|---|---|---|
| 10 | 0.51 | 0.8472 | 0.6923 | 0.7454 | 0.8453 | 2.31 |
| 10 | 0.60 | 0.8341 | 0.6923 | 0.8699 | 0.8331 | 0.77 |
| 10 | 0.70 | 0.8209 | 0.6923 | 1.0209 | 0.8206 | 0.22 |
| 10 | 0.76 | 0.8084 | 0.6923 | 1.2028 | 0.8082 | 0.06 |
| 10 | 1.00 | 0.7944 | 0.6923 | 1.4585 | 0.7944 | 0.02 |
| 20 | 0.46 | 0.8643 | 0.7009 | 0.6712 | 0.8589 | 3.00 |
| 20 | 0.79 | 0.8123 | 0.7009 | 1.2479 | 0.8119 | 0.17 |
| 20 | 1.00 | 0.7975 | 0.7009 | 1.5395 | 0.7974 | 0.03 |
| 30 | 0.50 | 0.8594 | 0.7095 | 0.7399 | 0.8567 | 2.92 |
| 30 | 0.70 | 0.8333 | 0.7095 | 1.0342 | 0.8317 | 1.59 |
| 30 | 0.80 | 0.8234 | 0.7095 | 1.1818 | 0.8221 | 0.63 |
| 30 | 0.90 | 0.8137 | 0.7095 | 1.3458 | 0.8131 | 0.29 |
| 30 | 1.04 | 0.8013 | 0.7095 | 1.6115 | 0.8012 | 0.06 |

TABLE 8d

Summary of Results, Aromatic/Paraffin Mixtures

| Toluene Concentration in Heptane | Solvent to Froth Ratio | Upper Phase Density | Solvent Density | Solvent to Bitumen Ratio | Density of Hydrocarbon | Water Content of HC Phase |
|---|---|---|---|---|---|---|
| 10 | 0.50 | 0.8564 | 0.7021 | 0.7071 | 0.8556 | 1.67 |
| 10 | 0.80 | 0.8286 | 0.7021 | 1.0085 | 0.8284 | 0.61 |
| 10 | 0.90 | 0.8160 | 0.7021 | 1.1987 | 0.8157 | 0.15 |
| 10 | 1.20 | 0.7881 | 0.7021 | 1.8056 | 0.7881 | 0.00 |
| 15 | 0.50 | 0.8527 | 0.7112 | 0.7998 | 0.8519 | 1.86 |
| 15 | 0.82 | 0.8157 | 0.7112 | 1.3222 | 0.8156 | 0.60 |
| 15 | 0.99 | 0.8069 | 0.7112 | 1.5106 | 0.8067 | 0.16 |
| 15 | 1.21 | 0.7962 | 0.7112 | 1.7907 | 0.7960 | 0.03 |
| 30 | 0.51 | 0.8711 | 0.7387 | 0.7823 | 0.8706 | 1.76 |
| 30 | 0.80 | 0.8428 | 0.7387 | 1.1988 | 0.8421 | 0.82 |
| 30 | 1.00 | 0.8389 | 0.7387 | 1.2641 | 0.8387 | 0.38 |
| 30 | 1.21 | 0.8263 | 0.7387 | 1.5485 | 0.8263 | 0.23 |
| 30 | 1.51 | 0.811O | 0.7387 | 2.0326 | 0.8109 | 0.07 |

EXAMPLE VIII

It has long been recognized that asphaltenes will precipitate in pentane. It was reported by Reichert, C., Fuhr, B. J., and Klein, L. L., in "Measurement of asphaltene flocculation in bitumen solutions", J. Can. Pet. Tech. 25(5), 33, 1986, that the onset of asphaltene precipitation in pentane occurs when 1.92 ml/g of pentane is added to Athabasca bitumen. Considering the bitumen content (66.22%) in the tested froth sample, the asphaltene precipitation threshold is equivalent to 1.27 ml/g of pentane for the froth sample.

As previously established, the minimum solvent to froth ratios for hexane diluent and heptane diluent for water elimination are about 0.60 g/g and 0.80 g/g of solvent based on froth, respectively. By considering the densities of the diluents, these ratios are converted to 0.90 ml/g for hexane and 1.17 ml/g for heptane diluents. Since asphaltene solubility in hexane and heptane is higher than in pentane, it appears that asphaltene precipitation should not be significant in hexane or heptane at S/F ratios close to the inversion point.

To further demonstrate that inversion of the emulsion and not asphaltene precipitation was taking place, a test was conducted where heptane was added to bitumen in different amounts and the quantities of asphaltene precipitating from the solution was observed. The results are reported in Table 9 and clearly show that asphaltenes begin to precipitate from solution at ratios in excess of approximately 1.0 w/w heptane to froth, which exceeds the inversion value of 0.8 w/w heptane to froth as obtained from FIG. 3.

TABLE 9

Asphaltene Precipitation Observations with Heptane Diluent

| | | | | | | | | |
|---|---|---|---|---|---|---|---|---|
| Heptane to bitumen ratio (w/w) | 0.68 | 1.06 | 1.21 | 1.37 | 1.50 | 1.60 | 2.04 | 5.00 |
| Equivalent heptane to froth ratio (w/w) | 0.45 | 0.70 | 0.80 | 0.91 | 1.00 | 1.06 | 1.35 | 3.11 |
| Asphaltene precipitation at room temp. | No | No | No | No | No | little | some | lots |
| Asphaltene precipitation at 80° C. | No | No | No | No | No | little | some | lots |

This point is significant for the following reason. There is a hydrocarbon loss with the water fraction. If this loss is asphaltenes, then there is no practical way known to applicants for recovering these lost hydrocarbons.

In conclusion, the foregoing examples support:

(1) That paraffinic solvents when used as diluents for froth treatment at appropriate S/F ratios will eliminate substantially all of the water and chloride from froth upon separation using centrifugation or gravity settling;

(2) Both normal and iso paraffinic solvents are efficient in generating dry diluted bitumen products;

(3) Sufficient paraffinic solvent to achieve inversion is needed to produce dry bitumen product—the critical S/F ratio will vary somewhat with the solvent used;

(4) The process works at low and high temperatures; and (5) Asphaltene precipitation does not appear to be a problem.

EXAMPLE IX

A typical commercial solvent, which is largely paraffinic and commonly consists of $C_4$–$C_{20}$ hydrocarbons, is natural gas condensate ("NGL"). The composition of this solvent is compared with the Plant 7 naphtha in Table 10, in which the composition is described by various hydrocarbon classes.

TABLE 10

Typical Hydrocarbon Class Compositions of Natural Gas Condensate and Plant 7 Naphtha

| Component | Paraffins | Naphithenes | Aromatics |
|---|---|---|---|
| Naphtha | 43% | 40% | 17% |
| Natural Gas Condensate | 83% | 12% | 5% |

Table 11 and FIG. 4 illustrate water removal at different solvent/froth ratios using natural gas condensate as a solvent. In this example, water and solids were eliminated from the hydrocarbon at solvent/froth ratios exceeding 1.0 w/w.

TABLE 11

Water Removal Results From Froth With Natural Gas Condensate As Diluent By Gravity Settling at 40° C.

| Solvent | NGC | NGC | NGC | Pt.7 Naphtha | |
|---|---|---|---|---|---|
| Solvent/Froth Ratio (w/w) | 0.80 | 1.00 | 1.20 | 1.35 | |
| Temperature (° C.) | 40 | 40 | 40 | 80 | |
| | Water Content in Oil Phase (%) | | | | |
| Settling time (min) | 0 | 8.83 | 8.16 | 7.58 | 8.03 |
| | 5 | 7.32 | 6.79 | 6.22 | 2.71 |
| | 15 | 6.01 | 2.8 | <0.1 | 2.4 |
| | 30 | 1.75 | <0.1 | <0.1 | 2.08 |
| | 45 | 1.72 | <0.1 | <0.1 | |
| | 60 | 1.62 | <0.1 | <0.1 | 1.71 |
| | 90 | | | | 1.47 |
| | 120 | | | | 1.22 |

As shown, runs were carried out using S/F ratios of 0.80, 1.00, and 1.20. On the run having a S/F ratio of 1.00, the water removal increased dramatically (relative to S/F ratio= 0.80 run) and dry bitumen was produced. Stated otherwise, inversion was obtained using NGC at S/F ratio of 1.00 (w/w).

By comparison, a run using Plant 7 naphtha at 80° C. and S/F ratio of 1.35 was unsuccessful in producing dry bitumen.

As stated, using NGC as the diluent at S/F ratios of 1.00 or greater resulted in substantially all of the water being removed from the oil. However a brownish rag layer was produced between the oil and water layers. See FIG. 4 and Table 12.

TABLE 12

Rag Layers Produced During Gravity Settling with Natural Gas Condensate as Froth Diluent

| Settling time (min) | Rag layer/(rag layer + upper oil layer); Vol % NGC/Froth = 1.00(w/w) | NGC/Froth = 1.20(w/w) |
|---|---|---|
| 30 | 30% | 25% |
| 60 | 23% | 17% |
| 90 | 22% | 15% |
| 120 | 18% | 13% |
| 3 days | 9% | 8% |
| Composition of rag after 120 min settling | 51.97% + 48.03% water plus solids | / |

As settling was extended, the volume of the rag layer diminished. After settling for 120 minutes, the composition of the rag layer reached about 50% oil and 50% water plus solids.

When the rag layer was separated from the other layers and centrifuged at 2000 rpm for 10 minutes, the water and hydrocarbon separated, leaving oil containing less than 0.1% water.

EXAMPLE X

This example reports on a run conducted in a scaled up pilot circuit using NGC as the diluent. The run was operated at 50° C. and then the temperature was increased over time, reaching 127° C. The S/F ratio was maintained at about 1.20 (w/w).

The pilot unit used is outlined schematically in FIG. 5.

The results are set forth in Table 13.

The pilot unit consisted of a feed system where froth and diluent were pumped through a heater and into a mixing vessel which had a nominal retention time of 2–5 minutes. Pressures in the system were held at approximately 1000 Kpa. Product from the mixer was passed under pressure into the settling vessel which had a nominal 15 minutes residence time. The oil/water interface was monitored and controlled by a conductivity probe. The products, both hydrocarbon and slurry underflow, were discharged from the process through coolers and then the pressure released through positive displacement pumps.

The run continued for a period of 7¼ hours with approximately one-half of the operating time at 50° C. and the other half at 117° C. (ave).

The results show that dry diluted bitumen could be recovered when the process was operated at both temperatures. (See Table 13.)

TABLE 13

Froth Treatment Pilot Test Results with Natural Gas Condensate as Froth Diluent

| | Froth Flow Kg/min | Condensate Flow kg/min | Diluent Froth Flow kg/min | Settler Product kg/min | Settler Tails kg/min |
|---|---|---|---|---|---|
| Run #1 | 0.823 | 0.881 | 1.704 | 1.10 | 0.60 |
| Rune #2 | 0.823 | 0.966 | 1.788 | 1.39 | 0.40 |

| | Temperature Deg C | Mixing Speed | Pressure Kpa | Hydrocarbon Recovery (%) | Product Quality (% HC) | Chloride Removal (%) Wt. % | Hydrocarbon Solids Content |
|---|---|---|---|---|---|---|---|
| Run #1 | 49 | 500 | 1000 | 83.8 | 99.2 | 98 | 0.06 |
| Run #2 | 117 | 500 | 1000 | 97.6 | 90.7 | 77 | 0.32 |

TABLE 14

Centrifuging Results of Underflows From Pilot Runs

| Underflow Sample | From 50° C. pilot run; Natural gas condensate | From 120° C. pilot run; Natural gas condensate | From 120° C. pilot run; Plant 7 naphtha |
|---|---|---|---|
| Density of U/F before cent. | 0.92 g/ml | 0.98 g/ml | |
| Upper oil after centrifuging | 33.8% | 11.8% | 9.0% |
| Rag after centrifuging | 41.2% | 3.4% | none |
| Water after centrifuging | 14.7% | 58.9% | 71.3% |
| Bottom solids after cent. | 10.3% | 25.9% | 19.7% |

TABLE 14-continued

Centrifuging Results of Underflows From Pilot Runs

| Underflow Sample | From 50° C. pilot run; Natural gas condensate | From 120° C. pilot run; Natural gas condensate | From 120° C. pilot run; Plant 7 naphtha |
|---|---|---|---|
| Water % in rag from cent. | 73.8% | 50.5% | / |
| Water % in recovered oil by cent. | <0.1% | <0.1% | 0.35% |

However, it was found that, at the low operating temperature (50° C.), oil losses with the water and solids underflow were relatively high. At the high operating temperature (~120° C.), the oil losses with the underflow were minimal. More particularly, samples of the underflow were centrifuged in a laboratory centrifuge at 2000 rpm for 10 minutes. The centrifuge contents separated into 4 layers, specifically: a clean oil layer; a viscous rag layer; a water layer; and a solids layer. The relative proportions are stated in Table 14. Most of the solids in the hydrocarbon were also removed.

In conclusion, the results teach that NGC can successfully be used as the diluent at low and high temperatures to yield dry diluted bitumen. However, the low temperature process produces relatively low quality underflow and the underflow has a relatively high rag content.

EXAMPLE XI

This example provides a detailed analysis of the product bitumen and the tailings which are produced in the froth treatment process described in Example X. In order to maximize the quality enhancement:

a relatively high solvent/froth (natural gas condensate) ratio of 1.58 was used; and the run was conducted at 50° C.

The lower temperature was chosen on the basis of Example X which demonstrated that while the bitumen recovery was higher if the run was conducted at 117° C., the product might be of higher quality if the temperature was 49° C. A summary of the operating conditions and process performance data for the run are shown in Table 15.

Three samples were taken from the unit:

feed to the unit before dilution (froth);

product from the unit (diluted bitumen); and tailings from the unit.

The composition and properties of the three fractions were determined using methodology which is well known in the field of bitumen upgrading. Analyses were carried out in accordance with the methods documented in the analytical methods directory of the LAN. The bitumen fraction of interest in the three samples was selected to be that fraction of hydrocarbon which boils above 343° C. The diluted bitumen product was sufficiently low in water and solids and was dilute enough that the fraction of the hydrocarbon with bp above 343° C. could be directly recovered from the sample through distillation on a true boiling point distillation apparatus. The froth and tailings samples both had significant water and solids contents. Therefore, before distillation, they were first extracted with hot toluene in a Dean Starke apparatus to isolate the hydrocarbon portion of the sample. This was then subjected to the identical distillation process as the diluted bitumen sample.

The data from the analyses performed on the bitumen recovered from the three distillations is shown in Table 16. The results show that the process yielded a bitumen product which was significantly different from that obtained from the conventional froth treatment process. In particular, the product bitumen from this process in comparison to the standard product had:

almost no extraneous matter;

less aromatics;

less micro-carbon residue;

less nitrogen;

less sulphur;

less pentane insoluble material;

a better carbon to hydrogen ratio; and a lower density.

"Extraneous matter" comprises material which can be measured as "solids" in the Dean Stark analysis, plus any other toluene-insoluble material which can be recovered by filtration. It is basically a measurement of non-bitumen material.

There was also a drastic reduction in the viscosity as compared to the feed bitumen, from 1880–324 mPa.s @ 100° C.

In summary, this example demonstrates that it is possible to produce a highly purified dry bitumen product using the paraffin froth treatment process of the invention. The product bitumen has a water content of less than about 0.1%, an extraneous matter and solids content of less than about 0.1%, and a reduced viscosity of generally less than about 500 mPa.s @ 100° C. The inventors believe that a highly purified bitumen product has not heretofore existed.

Although the quality of the bitumen which is described in Example XI happened to have been achieved using the paraffin froth treatment process under the conditions outlined in Table 15 (natural gas condensate used at a solvent/froth ratio of 1.58 at 50° C.), the inventors believe that bitumen of equivalent purity can be produced using other paraffinic solvents as outlined herein.

The inventors believe that the purity of the product bitumen obtained from the Paraffin Froth Treatment process will provide the following benefits in upgrading:

In the conventional Froth Treatment process, employing Naphtha as a diluent, the product bitumen contains inorganic solids which end up as "ash" constituents in coke, as a fouling deposit on the inside of process equipment and piping, or as deposits on catalyst pellets. These deposits ultimately lead to shut-down for cleaning, frequent repairs, and the consumption of catalyst used in the hydrocracking process. The removal of virtually all inorganic solids from the product bitumen should reduce the rate of fouling and catalyst poisoning.

Product bitumen which is free of inorganic solids can be channelled to primary upgrading steps that previously were precluded. For example, processes such as Vega Combi-Cracking (VCC), which may be superior in yield and quality of products made from raw bitumen cannot accept feeds containing significant solid impurities.

The product bitumen is clean enough to meet the Bottom Sediment and Water (BS&W) specifications of pipeline operators. The product bitumen would therefore only need to be reduced in viscosity to meet pipeline specifications. This might be accomplished by the addition of a small quantity of light hydrocarbon diluent (such as natural gas condensate) or by the application of a mild "vis-breaking" technology such as heat-soaking or low severity catalytic treatments.

If the product bitumen is produced under conditions which render it low in viscosity, such as in Example II, the product bitumen would be pumpable with none or very little dilution. This could eliminate the necessity of coupling extraction with upgrading facilities.

TABLE 15

Paraffin Froth Treatment Process Performance Data Using Natural Gas Condensates As Solvent

| Parameter | Value |
|---|---|
| Solvent to Froth Ratio (wt/wt) | 1.58 |
| Solvent to Bitumen Ratio (wt/wt) | 2.5 |
| Mixer Temperature (° C.) | 50 |
| Product Quality | |
| Hydrocarbon (%/wt) | 99.92 |
| Water(%/wt) | 0.08 |
| Solids (%/wt) | 0.00 |
| Bitumen Recovery (%) | 87.6 |

TABLE 16

Comparison of +343° C. Fractions of Feed, Product and Tailings Bitumen

| Analysis | Feed Bitumen | Product Bitumen | Tailings Bitumen | Typical Coker Feed Bitumen |
|---|---|---|---|---|
| Carbon wt % | 80 | 83 | 79 | 83 |
| Hydrogen wt % | 10.1 | 10.4 | 9.5 | 10.4 |
| C/H ratio | 7.9 | 8.0 | 8.3 | 8.0 |
| % C in aromatic environment | 31.0 | 28.3 | 32.2 | |
| Sulphur wt ppm | 52400 | 47500 | 56000 | 49700 |
| Nitrogen wt ppm | 5240 | 4770 | 6600 | 5870 |
| Basic Nitrogen wt ppm | 1520 | 1340 | 1860 | |
| extraneous matter wt % | 0.83 | 0.02 | 1.43 | 0.50 |
| micro carbon residue wt % (not corrected for "extraneous matter" wt) | 16.3 | 13.7 | 24.2 | 15.0 |
| pentane insolubles wt % | 21.4 | 12.7 | 39.2 | |
| density gm/cc @60° C. | 1.030 | 1.007 | 1.071 | |
| viscosity mPa.s @100° C. | 1880 | 324 | 49200 | |
| % recovered @524° C. | 35.6 | 44.2 | 29.5 | 41.5 |

The embodiments of the invention in which an exclusive property or privilege is claimed are defined as follows:

1. A method for cleaning bitumen froth comprising hydrocarbon and aqueous chases and containing water and particulate solids dispersed in the hydrocarbon phase in the form of an emulsion, said froth having been produced by a water extraction process practised on oil sand, comprising:

adding a sufficient amount of paraffinic solvent to the froth to induce inversion of the emulsion;

mixing the froth and the solvent for a sufficient time to disperse the solvent in the froth; and subjecting the mixture to gravity or centrifugal separation for a sufficient period to separate substantially all of the water and solids from the bitumen to produce dry diluted bitumen whose water plus solids content is less than about 0.5 weight percent.

2. A method for delivering oil sand-derived bitumen through a pipeline, comprising;

subjecting the oil sand to a water extraction process to obtain a bitumen froth, the bitumen froth comprising hydrocarbon and aqueous phases and containing water and particulate solids dispersed in the hydrocarbon phase in the form of an emulsion;

cleaning the bitumen froth to remove water and particulate solids contaminants, the cleaning process comprising adding a sufficient amount of paraffinic solvent to the froth to induce inversion of the emulsion, mixing the froth and solvent for a sufficient time to disperse the solvent in the froth, and subjecting the mixture to gravity or centrifugal separation for a sufficient period to separate substantially all of the water and solids from the bitumen to produce dry diluted bitumen; and pumping the dry diluted bitumen through a pipeline.

3. The method as set forth in claim 1, wherein the solvent is natural gas condensate containing more than 50% paraffins.

4. The method as set forth in claim 1 wherein the solvent is natural gas condensate containing more than 50% paraffins and is added in sufficient amount to produce a solvent to froth ratio of about 1.00 (w/w).

5. The method as set forth in claim 1 wherein the solvent is natural gas condensate containing more than 50% paraffin and is added in sufficient amount to produce a solvent to froth ratio of about 1.5 (w/w).

6. The method as set forth in claim 2, wherein the solvent is natural gas condensate containing more than 50% paraffins.

7. The method as set forth in claim 2, wherein the solvent is natural gas condensate containing more than 50% paraffins and is added in sufficient amount to produce a solvent to froth ratio of about 1.00 (w/w).

8. the method as set forth in claim 2, wherein the solvent is natural gas condensate containing more than 50% paraffin and is added in sufficient amount to produce a solvent to froth ratio of about 1.5 (w/w).

9. A dry diluted bitumen product having a water content of less than about 0.1 weight %, a solids content of less than about 0.1 weight %, and an extraneous matter content of less than about 0.1 weight %, said bitumen product having been produced by the method of claim 1.

10. A dry diluted bitumen product having a water content of less than about 0.1 weight %, a solids content of less than about 0.1 weight %, and an extraneous matter content of less than about 0.1 weight %, said bitumen product having been produced by the method of claim 5.

11. A dry diluted bitumen product having a water content of less than about 0.1 weight %, a solids content of less than about 0.1 weight %, and an extraneous matter content of less than about 0.1 weight %, said bitumen product having been produced by the method of claim 4.

12. A dry diluted bitumen product having a water content of less than about 0.1 weight %, a solids content of less than about 0.1 weight %, and an extraneous matter content of less than about 0.1 weight %, said bitumen product having been produced by the method of claim 5.

* * * * *